United States Patent [19]

Mosteller

[11] Patent Number: 4,953,817

[45] Date of Patent: Sep. 4, 1990

[54] CHAIN LINK FENCE HANGER

[76] Inventor: Peter Mosteller, 103 Linden Ave., Riverton, N.J. 08077

[21] Appl. No.: 408,863

[22] Filed: Sep. 18, 1989

[51] Int. Cl.[5] ..... A47F 7/00

[52] U.S. Cl. ..... 248/222.2; 248/303; 248/304; 24/686

[58] Field of Search ..... 248/302, 303, 222.2, 248/215, 225.2, 225.31, 227, 231.8, 304, 339, 340, 689; 24/686

[56] References Cited

U.S. PATENT DOCUMENTS

| | | | |
|---|---|---|---|
| 1,559,783 | 11/1925 | Rose | 248/304 |
| 1,575,409 | 3/1926 | Blaesen | 40/596 |
| 1,665,785 | 4/1928 | Illch | 248/222.2 |
| 1,873,297 | 8/1932 | Davenport | 248/222.2 |
| 1,951,930 | 3/1934 | Harris | 248/231.8 |
| 2,196,196 | 4/1940 | Dorsey | 248/304 |
| 2,981,513 | 4/1961 | Brown | 248/221.2 |
| 3,789,800 | 2/1974 | Stuedler, Jr. | 248/221.4 |
| 3,972,499 | 8/1976 | Simmons | 248/221.2 |
| 4,025,018 | 5/1977 | Thalenfeld | 248/303 |
| 4,049,126 | 9/1977 | Halverson | 248/220.4 |
| 4,340,144 | 7/1982 | Cousins | 248/222.2 |

FOREIGN PATENT DOCUMENTS 1492875 7/1967 France .

*Primary Examiner*—Ramon O. Ramirez
*Assistant Examiner*—Robert A. Olson
*Attorney, Agent, or Firm*—Norman E. Lehrer

[57] ABSTRACT

A hanger, particularly adapted to connect or attach items to a chain link fence, includes a central hub portion which is preferably spherically shaped and three arms which extend outwardly therefrom. Two of the arms extend to the sides and are bent rearwardly terminating in ball-shaped cams. The third arm extends upwardly and has its free end bent forwardly and also terminating in a ball. The hanger is attached to a fence by feeding the end of the third leg under one of the diagonally extending fence wires and then snapping the balls at the ends of the other two arms around the outer edges of the two spaced apart fence wires that are perpendicular to the first wire. With the hanger in place, a variety of different articles can be suspended from a hook or other type of support mounted on the central hub portion.

19 Claims, 2 Drawing Sheets

CHAIN LINK FENCE HANGER

BACKGROUND OF THE INVENTION

The present invention is directed toward a chain link fence hanger and more particularly toward such a hanger which can be quickly but securely fastened to a chain link fence and quickly removed therefrom and which is capable of supporting a wide variety of different articles.

The invention is particularly useful in connection with amateur sporting games such as baseball, tennis and others where chain link fences are used to enclose a playing area or to protect players or spectators from injury. At such events, players often bring with them jackets, hats and other articles of clothing which are normally simply tossed on the ground since there is rarely any convenient place to hang them. Furthermore, the players often have equipment such as bats, gloves, helmets or rackets which are also often simply thrown on the ground for lack of a convenient storage means.

Proposals have been set forth in the past for providing specific hanging arrangements for chain link fences. One such device is shown, for example, in U.S. Pat. No. 4,049,126 to Halverson. This patent is directed toward a foldable rack which is specifically intended to hang baseball bats therefrom. While this device may be capable of supporting a plurality of baseball bats, it is somewhat complex and, therefore, relatively expensive to manufacture. Furthermore, its use is limited to supporting baseball bats and cannot support other types of equipment or clothing.

A more general type of hanger is disclosed in U.S. Pat. No. 3,972,499 to Simmons. This device is essentially an S-shaped element having a hook at the end which is basically woven through an opening in the fence. While this device may be of some benefit, it also can support only those articles which can be placed on the hook which is incorporated therein. Furthermore, because of the manner in which the device connects to the fence, it is possible that the same could become dislodged if the fence were shaken by being hit by a ball or player.

Specialized devices have also been proposed in the past which are specifically designed to secure particular items to a wire mesh screen or fence or the like. U.S. Pat. No. 2,981,513 to Brown and U.S. Pat. No. 3,789,800 to Steudler, for example, show clips which are particularly adapted to hold a pipe to a wire cage. U.S. Pat. No. 4,340,144 shows an article support arrangement which is used in connection with a wire grid. While these devices may work for their intended purposes, they cannot be used for supporting a variety of different types of articles on a chain link fence.

U.S. Pat. No. 1,575,409 to Blaeser discloses a name plate which is particularly adapted to be connected to a chain link fence. There is no suggestion, however, that the device shown therein can be used to support articles of clothing or sporting equipment or the like.

While the present invention is particularly useful for supporting clothing or sporting equipment from a chain link fence, it is not limited thereto. As will become more readily apparent hereinafter, the invention can be used to support substantially any type of article on the fence.

SUMMARY OF THE INVENTION

The present invention is intended to overcome all of the deficiencies of the prior art described above. The hanger of the present invention is particularly adapted to connect or attach substantially any item to a chain link fence and includes a central hub portion which is preferably spherically shaped and three arms which extend outwardly therefrom. Two of the arms extend to the sides and are bent rearwardly terminating in ball-shaped cams. The third arm extends upwardly and has its free end bent forwardly and also terminating in a ball. The hanger is attached to a fence by feeding the end of the third leg under one of the diagonally extending fence wires and then snapping the balls at the ends of the other two arms around the outer edges of the two spaced apart fence wires that are perpendicular to the first wire. With the hanger in place, a variety of different articles can be suspended from a hook or other type of support mounted on the central hub portion.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
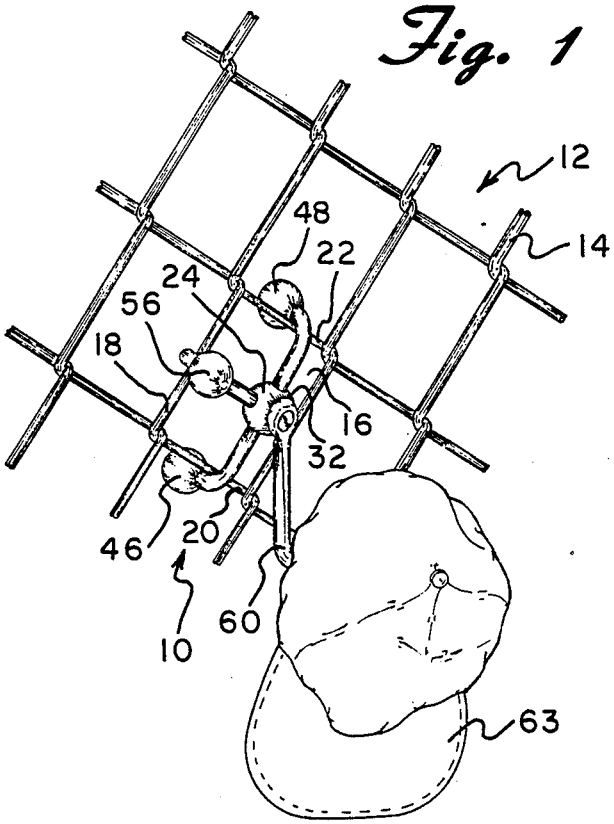
FIG. 1 is a front perspective view of a chain link fence hanger constructed in accordance with the principles of the present invention and showing the manner in which the same can support a baseball cap on a fence.
Figure 2:
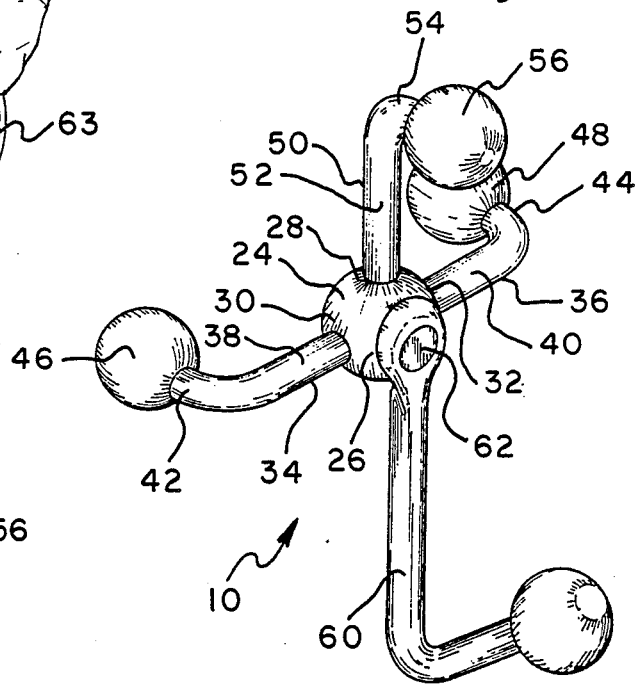
FIG. 2 is a front perspective view of the hanger of FIG. 1.
Figure 3:
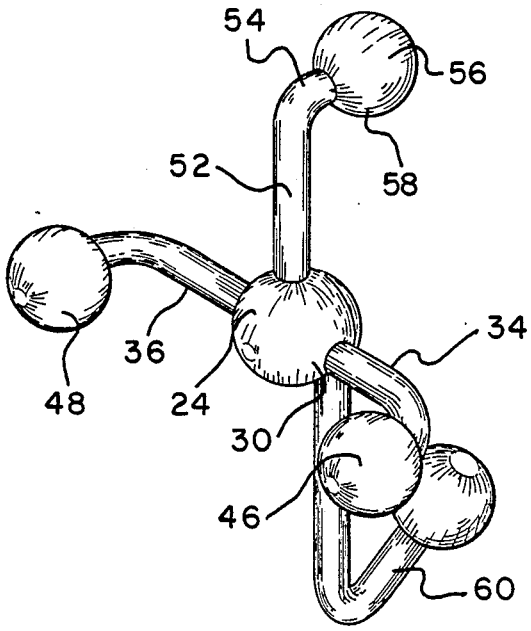
FIG. 3 is a rear perspective view thereof.
Figure 4:
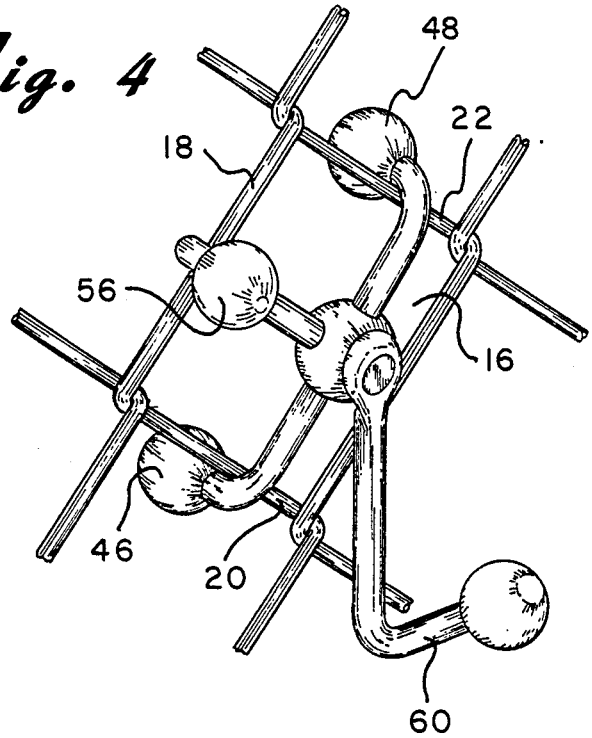
FIG. 4 is a front perspective view similar to FIG. 1 but showing the hanger without the cap.

Referring now to the drawings in detail wherein like reference numerals have been used throughout the various figures to designate like elements, there is shown in FIGS. 1–4 a first embodiment of a chain link fence hanger constructed in accordance with the principles of the present invention and designated generally as 10. FIGS. 1 and 3 show the hanger 10 mounted on a chain link fence 12 which, as is well known, is comprised of spirally arranged wires 14 which form the periphery of a plurality of diamond-shaped openings 16. As illustrated in FIGS. 1 and 4, the segments of the wires which extend diagonally from the lower left to the upper right such as wire segment 18 can be considered the forward wire segments while the wire segments such as shown at 20 and 22 which are essentially perpendicular to wire segment 18 lie slightly behind the plane of wire segment 18 and can be considered to be the rear segments.

The hanger 10 is comprised essentially of a centrally located hub member 24 which, in the preferred embodiment, is substantially spherically shaped. However, this is by way of example only as numerous other shapes are also possible. The hub member 24 has a front 26, top 28 and opposed left and right sides 30 and 32.

First and second opposed arms 34 and 36 include main substantially straight portions 38 and 40 which are connected to the left and right sides 30 and 32, respectively, of the hub 24 and extend generally outwardly therefrom in opposite directions. The main portions 38 and 40 are in essentially axial alignment with each other. The free ends 42 and 44 of the arms 34 and 36 are bent so as to extend rearwardly. These free ends 42 and 44 are substantially parallel to each other but are spaced apart approximately the same distance as the distance between the wire segments 20 and 22 of the chain link fence 12. Cam elements in the form of spherically shaped balls 46 and 48 are securely mounted at the remote ends of the arms 34 and 36.

A third arm 50 is connected to and extends upwardly from the top 28 of hub 24. The arm 50 has a main portion 52 which lies in substantially the same plane as the main portions 38 and 40 of the arms 34 and 36 but is perpendicular thereto. The free end 54 of the arm 50 is bent so as to extend forwardly as viewed in FIGS. 1, 2 and 4. A spherically shaped element 56 is securely fastened to the remote end of the arm 50. Because the spherically shaped element or ball 56 is larger than the diameter of the arm 50, the lowermost portion 58 of the ball 56 (FIG. 3) is slightly lower than the third arm portion 54. Thus, the free end of the third arm 50 actually can be considered to extend both forwardly and downwardly. The main portions and free ends of the first and second arms lie generally in a plane which is perpendicular to the main portion of the third arm.

Connected to the front 26 of the hub 24 is a hook member 60. Preferably the hook member 60 is secured to the hub 24 through the use of a pivot pin 62 so that the hook member 60 can pivot or swing at least through a limited range about the hub 24. This allows the hook member 60 to be moved into a vertical orientation irrespective of the orientation of the main portion of the hanger 10.

The hanger 10 thus described is utilized in the following manner. Holding the hanger member by gripping the hub portion, the ball 56 at the end of the upper arm 50 is passed through one of the openings 16 in the chain link fence. From there, it is passed behind one of the wire segments 18 and then again forwardly until the ball 56 lies forwardly of the wire segment 18. At this point, the hanger 10 is moved downwardly and to the right until the undersurface of the upper arm portion 54 engages the wire segment 18. The balls 46 and 48 are then placed against the forward and outer edges of the wire segments 20 and 22. As an inward force (toward the fence) is placed on the hub member 24, the inner convex surfaces of the balls 46 and 48 which face inwardly toward each other function as camming members and slide around the wire segments 20 and 22 as the balls flex these wire segments inwardly toward each other. Obviously the balls 46 and 48 may also be flexed slightly away from each other. Once the balls pass the wire segments 20 and 22, the wire segments and the balls return to their normal positions and lock the hanger in place as shown in FIGS. 1 and 4. The hanger 10 is removed by simply reversing the above procedure.

With the hanger 10 securely fastened to a chain link fence as described above, a hat 63 or other article of clothing or various other articles can be hung on the hook 60 as shown in FIG. 1. The hook 60, however, is by way of example only as numerous other types of attaching means can be connected to the hub member 24. An alternate type of attaching means is shown, for example, in FIG. 5.

Figure 5:
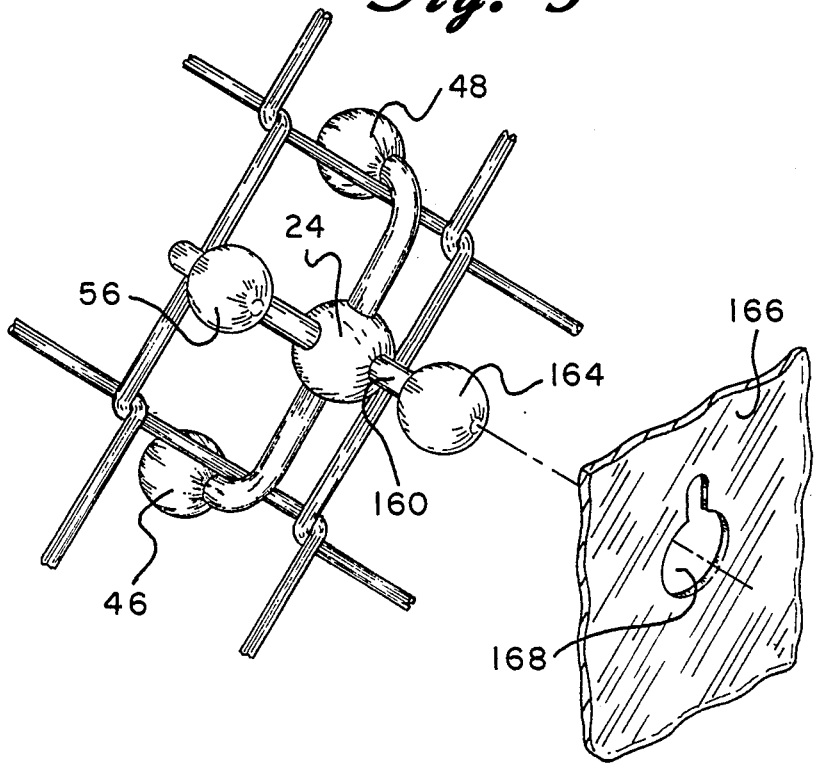
FIG. 5 is a view similar to FIG. 4 showing a modified form of the invention.

The hanger 110 shown in FIG. 5 illustrates one alternate form of the invention. Hanger 110 also includes a hub member 24 and arms and balls which are substantially identical to those of hanger 10 and is secured to a chain link fence in substantially the same manner as described above. The only difference between hanger 110 and hanger 10 is the type of attaching means. In lieu of the hook 60, hanger 110 includes a short rod-shaped element 160 which is rigidly secured to the front 26 of the hub member 24. A ball 164 is secured to the forward free end of the rod 160. Substantially any item such as a sign, bird house or feeder, baseball bat holder, etc., can be connected to the hanger 110 by providing the rear wall 166 of the item with a keyhole-shaped opening such as shown at 168.

In the preferred form of the invention, substantially the entire hanger 10 or 110 is comprised of a substantially rigid plastic. This, however, is by way of example only as the hangers can be made from substantially any suitable material. Furthermore, they can be either molded as one piece or assembled from component parts.

The present invention may be embodied in other specific forms without departing from the spirit or essential attributes thereof and accordingly reference should be made to the appended claims rather than to the foregoing specification as indicating the scope of the invention.

I claim:

1. A hanger for attaching items to a chain link type fence comprising:

a hub member, said hub member having a front, opposed sides and a top;

first and second opposed arms, each of said first and second arms being connected to said hub member and having main portions which extend generally outwardly from either side thereof, the free end of each of said first and second arms extending rearwardly such that said free ends are spaced apart but substantially parallel to each other;

a third arm connected to said hub and extending generally upwardly therefrom, said third arm having a main portion which is in substantially the same plane as but perpendicular to said main portions of said first and second arms, the free end of said third arm extending forwardly and downwardly, said main portions of said first and second arms and said free ends thereof lying generally in a plane perpendicular to the main portion of said third arm, and attaching means connected to and accessible from the front of said hub member for supporting articles when said hanger is secured to a fence.

2. The invention as claimed in claim 1 wherein said arms are substantially rigid and are rigidly secured to said hub portion.

3. The invention as claimed in claim 1 wherein said attaching means is comprised of a short rod-shaped element extending forwardly of said hub member and terminating in a ball-shaped element.

4. The invention as claimed in claim 1 wherein said hanger is comprised essentially of plastic.

5. The invention as claimed in claim 1 wherein said attaching means is comprised of a hook means extending from said hub member.

6. The invention as claimed in claim 5, wherein said hook means is pivotally connected to said hub means.

7. The invention as claimed in claim 1 wherein each of said first and second arms carries a cam element adjacent its free end.

8. The invention as claimed in claim 7, wherein said cam elements are substantially spherically shaped.

9. The invention as claimed in claim 7, wherein said third arm carries a cam element adjacent its free end.

10. The invention as claimed in claim 9 wherein said cam elements are substantially spherically shaped.

11. The invention as claimed in claim 7 wherein each cam element includes a rounded convex member, the rounded convex members facing inwardly toward each other.

12. The invention as claimed in claim 11 wherein said arms are substantially rigid and are rigidly secured to said hub portion.

13. The invention as claimed in claim 11 wherein said cam elements are substantially spherically shaped.

14. The invention as claimed in claim 11 wherein said third arm carries a cam element adjacent its free end.

15. The invention as claimed in claim 14 wherein said cam elements are substantially spherically shaped.

16. The invention as claimed in claim 11 wherein said attaching means is comprised of a hook means extending from said hub member.

17. The invention as claimed in claim 16 wherein said hook means is pivotally connected to said hub means.

18. The invention as claimed in claim 11 wherein said attaching means is comprised of a short rod-shaped element extending forwardly of said hub member and terminating in a ball-shaped element.

19. The invention as claimed in claim 11 wherein said hanger is comprised essentially of plastic.

* * * * *